United States Patent [19]

Moll et al.

[11] 4,180,456

[45] Dec. 25, 1979

[54] PROCESS FOR RECOVERING A PREMIUM OIL FROM A SLURRY PRODUCED BY HIGH TEMPERATURE HYDROGENATION OF A SOLID, HYDROCARBONACEOUS FUEL

[75] Inventors: Norman G. Moll, Sanford; George J. Quarderer, Midland, both of Mich.

[73] Assignee: The Dow Chemical Company, Midland, Mich.

[21] Appl. No.: 916,674

[22] Filed: Jun. 19, 1978

Related U.S. Application Data

[63] Continuation-in-part of Ser. No. 809,958, Jun. 27, 1977, abandoned.

[51] Int. Cl.[2] ..... C10G 21/14

[52] U.S. Cl. ..... 208/177; 208/10

[58] Field of Search ..... 208/177, 10, 9, 8 LE

[56] References Cited

U.S. PATENT DOCUMENTS

| | | | |
|---|---|---|---|
| 3,583,900 | 6/1971 | Gatsis | 208/8 LE |
| 3,970,541 | 7/1976 | Williams et al. | 208/8 LE |
| 4,090,957 | 5/1978 | Leonard | 208/8 LE |

FOREIGN PATENT DOCUMENTS

| | | | |
|---|---|---|---|
| 2504488 | 8/1976 | Fed. Rep. of Germany | 208/177 |

*Primary Examiner*—George Crasanakis

*Attorney, Agent, or Firm*—G. R. Plotecher

[57] ABSTRACT

A feed slurry containing fine solids, polar liquids and premium liquid oil and produced by high temperature hydrogenation of a solid fuel, such as coal, is separated into a first fraction comprising the premium liquid oil and a second fraction comprising the fine solids and polar liquids by (a) contacting the feed slurry with a solvent, such as (1) $C_5$–$C_9$ aliphatic hydrocarbon (2) $C_5$–$C_9$ alicyclic hydrocarbon or (3) naphthenic or paraffinic fraction of a coal liquefaction product containing less than 10 wt. % aromatics at a temperature of 100°–250° C. and pressure sufficient to maintain the feed slurry and solvent in the liquid state but less than 450 psi. The feed slurry is introduced at or near the top of a contacting zone of a vertical column, which also has an upper settling zone and a lower collection zone, and the solvent is introduced at or near the bottom of the contacting zone of said column at a solvent; slurry wt ratio of at least 0.5:1, or more specifically at a ratio between 0.6:1 and 5:1. The first fraction is recovered as an overflow from the settling zone and the second fraction as an underflow from the collection zone. The column wall defining the collection zone is maintained at a temperature at least 20° C. above the temperature of that portion of the column wall defining the contacting zone, more specifically, the column wall defining the collection zone has a temperature of at least 150° C.

7 Claims, 3 Drawing Figures

PROCESS FOR RECOVERING A PREMIUM OIL FROM A SLURRY PRODUCED BY HIGH TEMPERATURE HYDROGENATION OF A SOLID, HYDROCARBONACEOUS FUEL

CROSS-REFERENCE TO RELATED APPLICATION

This application is a continuation-in-part of application, Ser. No. 809,958, filed June 27, 1977 and now abandoned.

BACKGROUND OF THE INVENTION

1. Field of the Invention

This invention relates to a process for separating a slurry comprising fine solids, polar liquids and premium oil, the slurry produced by high temperature hydrogenation of a solid, hydrocarbonaceous fuel, into a first fraction comprising the premium oil and a second fraction comprising the fine solids and polar liquids.

2. Description of the Prior Art

The high temperature hydrogenation of solid, hydrocarbonaceous fuels, such as the liquefaction of coal, produces a feed slurry, comprising not only premium liquid oil but also various solids, e.g., ash, inorganic sulfur, etc. and other liquids, e.g., polar liquids, etc. Removal or separation of these materials, especially the fine solids from the premium oil, is a major problem and has been the subject of much research.

British Pat. No. 312,657 discloses an apparatus and process for the separation from solid residues of oils obtained in the destructive hydrogenation varieties of coal, tars, mineral oils and the like. The apparatus comprises a vertical column with a settling vessel attached to its top and a worm gear attached to its bottom. The process comprises introducing a slurry of solid residues and oils into the column at or near the column top and a solvent, typically benzene, into the column at or near the column bottom such that the solvent, as it passes up the column, extracts from the slurry, as it passes down the column the oils. The solid residues are removed as a powder from the bottom of the column by the worm gear while the oils are removed from the top of the column as an overflow from the settling vessel.

Demex is a process for the removal of metals (generally chelated by a ligand such as porphyrin) and petroleum asphaltene from heavy residua of certain asphaltic base crudes. *Rev. Inst. Mex. Petrol.*, 6(1), 36–46 (1974). Although Demex involves countercurrent extraction within a vertical column, it is not designed for use with solid, hydrocarbonaceous fuel-derived oil (feed slurry), especially oil containing large amounts of fine solids.

Sze and Snell, U.S. Pat. Nos. 3,852,182 and 3,856,675, teach a fine solids removal process comprising contacting coal-derived oil with a promoter liquid in a mixing zone and then transferring the resulting liquid mixture to a gravity settling zone. The promoter liquid has a characterization factor of at least 9.75 and a preferred 5 volume percent distillation temperature of at least 400° F.

Two papers delivered by Gorin et al. at the Spring Meeting Division of Fuel Chemistry, ACS, Philadelphia, PA, Apr. 6–11, 1975, teach a fine solids removal process comprising adding a solvent to a stirred mix tank of coal liquefaction product. The resulting liquid mixture is then transferred to a gravity settling vessel wherein impurities are removed. This process is similar to that taught by Sze and Snell but differs in the operating pressure, the latter requiring greater pressures.

Kerr-McGee (U.S. Pat. Nos. 3,607,716 and 3,607,717) teaches a variation on the gravity settling process described by both Gorin et al. and Sze and Snell comprising removal from a coal liquefaction product fine solids using a solvent heated to a super-critical temperature. This process differs from others in that the solids settle in a dense phase gas (the solvent under super-critical conditions). The fine solids are contained in the extraction residue.

SUMMARY OF THE INVENTION

According to this invention, a slurry produced by high temperature hydrogenation of a solid, hydrocarbonaceous fuel and comprising fine solids, polar liquids and premium liquid oil is separated into a first fraction comprising the premium oil and a second fraction comprising the fine solids and polar liquids by an improved process comprising:

(a) contacting the slurry with a nonpolar, liquid solvent selected from the group consisting of $C_5$–$C_9$ aliphatic or alicyclic hydrocarbons and naphthenic or paraffinic portions of a coal liquefaction product consisting of less than about 10 weight percent aromatic hydrocarbons, in a vertical column comprising a first or settling zone, a second or contacting zone and a third or collection zone, all zones operated at temperatures and pressures sufficient to maintain both the slurry and solvent in the liquid state, the slurry introduced into the column at or near the top of the contacting zone and the solvent introduced into the column at or near the bottom of the contacting zone, the solvent and slurry contacted at a solvent:slurry weight ratio of at least about 0.5:1 and contacted in such a manner that the solvent:

(1) passes up and through the contacting zone while the slurry passes down and through the contacting zone;

(2) is in intimate contact with the slurry as they simultaneously pass through the column; and (3) extracts from the slurry as they simultaneously pass through the column the premium liquid oil;

(b) recovering from the settling zone of the column as an overflow the premium oil; and (c) recovering from the collection zone of the column, that portion of the column wall defining the collection zone maintained at a temperature at least about 20° C. above the temperature of that portion of the column wall defining the contact zone, as an underflow a residual slurry comprising the fine solids and polar liquids.

This process produces an essentially solids-free overflow of premium oil and an underflow containing a minimum amount of premium oil. Moreover, this process removes other materials, such as unconverted fuel, polar molecules rich in heteroatoms (O, N, S), etc.

DETAILED DESCRIPTION OF THE INVENTION

The slurry here used is a slurry generally produced from the high temperature hydrogenation of any solid, hydrocarbonaceous fuel. The slurry produced from the liquefaction of coal is illustrative. The solids portion of this slurry comprises fine solids (e.g., ash), inorganic sulfur (e.g., pyrrhotite) and organic solids (e.g., unreacted coal) while the liquid portion comprises premium oil (e.g., hexane-soluble slurry components, such as paraffinic, naphtenic and aromatic hydrocarbons), and polar liquids (e.g., asphaltenes and toluene insolubles, both defined hereinafter). "Fine" here describes solids or minute particles of about 0.1 to 20 microns in size. The solids content (weight basis) of this slurry can vary widely but is at least partially dependent upon the polar liquid's content. Generally, the more polar liquids present, the greater the solids content that can be effectively processed. Specifically, a sufficient quantity of polar liquids must be insoluble in the nonpolar solvent at column conditions such that the polar liquids coalesce to form a separate, liquid continuum in which the fine solids content can be dispersed. Although quantitative parameters can and will vary with the particular feed slurry, column conditions, solvent, etc., it can be generally said that the resultant underflow should comprise less than about 65 weight percent solids. Consequently, a slurry comprising a solids content less than about 25 weight percent is preferred and a slurry comprising a solids content less than about 20 weight percent more preferred.

In a specific embodiment of this invention wherein hexane is the nonpolar solvent, an especially suited slurry is produced by the liquefaction of a bituminous coal. This slurry can take many forms, such as the slurry as produced (ash content of about 3 to 8 weight percent), the slurry after some solids removal, e.g., centrifugation (ash content of about 0.5 to 5 weight percent), or the slurry after a solids concentration procedure, e.g., as the underflow from a hydrocyclone, (ash content of about 10–15 weight percent). The solids content of each of these forms is less than about 25 weight percent of the slurry.

The principle considerations in solvent selection are that the solvent selectively extracts the premium oil and that the solvent and premium oil (extract) not have significant overlap in their distillation ranges (since such overlap can result in cross-contamination). Since the components of the premium oil are generally nonpolar, a nonpolar solvent is used. The solvents are preferably hydrocarbon and more preferably $C_5$–$C_9$ aliphatic or alicyclic hydrocarbon, such as pentane, hexane, heptane, octane, 3-methylpentane, cyclopentane, cyclohexane, etc. Other suitable solvents include certain naphthenic or paraffinic fractions of a coal liquefaction product, such as a mixed $C_4$–$C_5$ portion or a paraffinic petroleum portion, such fractions containing less than-about 10 weight percent aromatic compounds.

Column conditions (temperature and pressure) can and will vary with the solvent and the composition of the feed slurry. A minimum column temperature is required sufficient to maintain the feed and residual slurries in the liquid state. The column temperature cannot exceed the critical temperature of the solvent. A minimum pressure is required sufficient to avoid vaporization of both the solvent and the feed slurry. Practical considerations, such as equipment, economy, etc., are the only limitations upon the maximum pressure that can be employed.

As here used, "column temperature", "zone temperature", and similar terms means the temperature of the column wall or that portion of the column wall defining a zone. The temperature of the slurry, solvent and separation products of the slurry may or may not obtain the same temperature of the column wall, depending upon the flow rate of these materials. Generally, the greater the flow rate, the less likely that these materials obtain the temperature of the column wall. Of course, the materials obtain the heat of the column wall by conduction.

Although column pressure is generally uniform throughout, column temperature generally varies from one area or zone of the column to another. Since the residual slurry is relatively high in solids and high molecular weight polar materials content, it is the most viscous and requires the greater temperature. Thus, the zone wherein this slurry collects is typically run at least about 20° C. higher than the remainder of the column.

Although quantitative temperature and pressure ranges cannot be stated generically, by way of illustration and with hexane as the solvent, a typical minimum column temperature (excluding the residual slurry collection zone) is at least about 100° C. and preferably about 140° C. The corresponding pressures are typically about 180 psi and 200 psi. A typical maximum temperature is about 225° C. and preferably about 200° C. with corresponding pressures of about 450 psi and about 325 psi. Although the residual slurry collection zone temperatures are generally about 20° C. higher, respectively, with comparable pressures, preferably the residual slurry collection zone is maintained at a temperature of at least about 150° C. and most preferably at about 180° C.

Premium oil extraction from the slurry is at least partially dependent upon the solvent:slurry weight ratio fed to the vertical column. Generally the greater the solids content of the slurry, the greater the solvent:oil ratio used in the practice of this invention. The use of a greater solvent:oil ratio under such circumstances leaves a greater amount of polar liquids in the slurry and these polar liquids promote coalescence among the solids and thus fluidity of the underflow. A typical minimum weight ratio of about 0.5:1 can be used although a ratio of about 0.6:1 is preferred. Practical considerations, such as energy efficiency, are the only limitations upon the maximum weight ratio although a maximum weight ratio of about 5:1, and preferably about 1:1, is typical. A weight ratio of about 0.8:1 is especially preferred. Generally, if the weight ratio is less than 0.5, i.e., less than 0.5:1, the recovered asphaltene has a reduced viscosity which indicates poor separation from the product liquid. Moreover, detection of an interface between the residual slurry and the solvent-slurry phases becomes difficult and the more difficult this becomes, the more difficult is the selective removal of the residual slurry from the vertical column. If the weight ratio is greater than about 1.0, feed slurry throughput (volume per unit time) is sacrificed and additional cost and utilities are incurred.

Although the physical features (housing and channel size and shape) of the vertical column here used can be varied to choice, the column is typically a hollow, elongated cylinder or pipe-like structure with a length over diameter (LOD) quotient between about 40 and 2 and preferably between about 20 and 5. The column can be made from any suitable material but materials, such as steel, known to perform well under elevated temperatures and pressures are preferred. The column generally comprises three zones: A first or settling zone, a second or contacting zone, and a third or collection zone.

The first or settling zone is generally the top portion of the column, equipped with a solvent-premium oil extract outlet, and commences above an entry port used for introducing the slurry into the second or contacting zone. This first or settling zone collects the solvent and premium oil flowing up from the second or contacting zone for its ultimate removal from the column. The function of this settling zone is to provide an area for the gravity separation of any fine solids that may have been carried from the contacting zone by the solvent and premium oil. As such, it is desirable that the solvent and premium oil be quiescent, i.e., have little or no convection currents, to encourage any fine solids to settle back into the contacting zone. On large scales, vertical baffles or other design features may be useful in preventing such convection currents and resulting fine solids presence in the column overflow.

The second or contacting zone is generally the mid-portion, i.e., the portion between the first and third zones, of the column and it generally is the largest (on an overall length basis) portion of the column. Within this zone, the slurry descends the column in a partially back-mixed, partially countercurrent mode. Although the solvent-premium oil phase is nearly completely back-mixed in this second zone (due to both the density difference between the premium oil and solvent and to convection currents), there is a net countercurrent flow of the residual slurry downward against the upflow of the solvent-premium oil phase. This second zone is equipped with a slurry entry port at or near its top and a solvent entry port at or near its bottom. Use of internals within this zone may be useful, especially in large-scale operations, to disrupt convection currents. Any such internals should be designed to avoid the buildup of asphaltenic residue with exposed surfaces generally no more than 30 degrees off the vertical axis of the column.

The third or collection zone is generally the bottom portion of the column and typically has an enlarged diameter relative to the first and second zones. This zone collects the residual slurry, i.e., fine solids and other materials comprising the slurry not soluble in the nonpolar solvent, for their ultimate removal from the column. The column wall defining this zone is generally maintained at a higher temperature than the wall defining the second zone because the residual slurry which is collected in the third zone has a greater viscosity than either the slurry, premium oil or solvent and thus requires a higher temperature to maintain its liquid state. Since the third zone, like the first and second zones, is generally operated on a continuous basis, the temperature differential exhibited between the wall defining the third zone and the wall defining the second zone is not believed paralleled by a similar temperature differential between the contents of the second zone and the contents of the third zone. However, it is believed that the higher temperature of the wall defining the third zone inhibits accumulation of the solids-containing residual phase along the interior of the wall and thus promotes a steady and uninterrupted discharge of the residual slurry.

The third zone is also equipped with a residual slurry outlet which can be located at any convenient point about the zone but is preferably located at the center of the bottom of the zone. This avoids solvent and premium oil escaping due to their bypassing the residual slurry. The residual slurry outlet can be equipped with any conventional means for facilitating the removal of the residual slurry from the zone, such as a valve, worm screw, extruder, etc.

In the accompanying drawings in which like numerals are employed to designate like parts throughout the same:

Various items of equipment, such as valves, fittings, condensors, pumps, etc. have been omitted so as to simplify the description. However, those skilled in the art will realize that such conventional equipment can be, and is, employed as desired.

Figure 1:
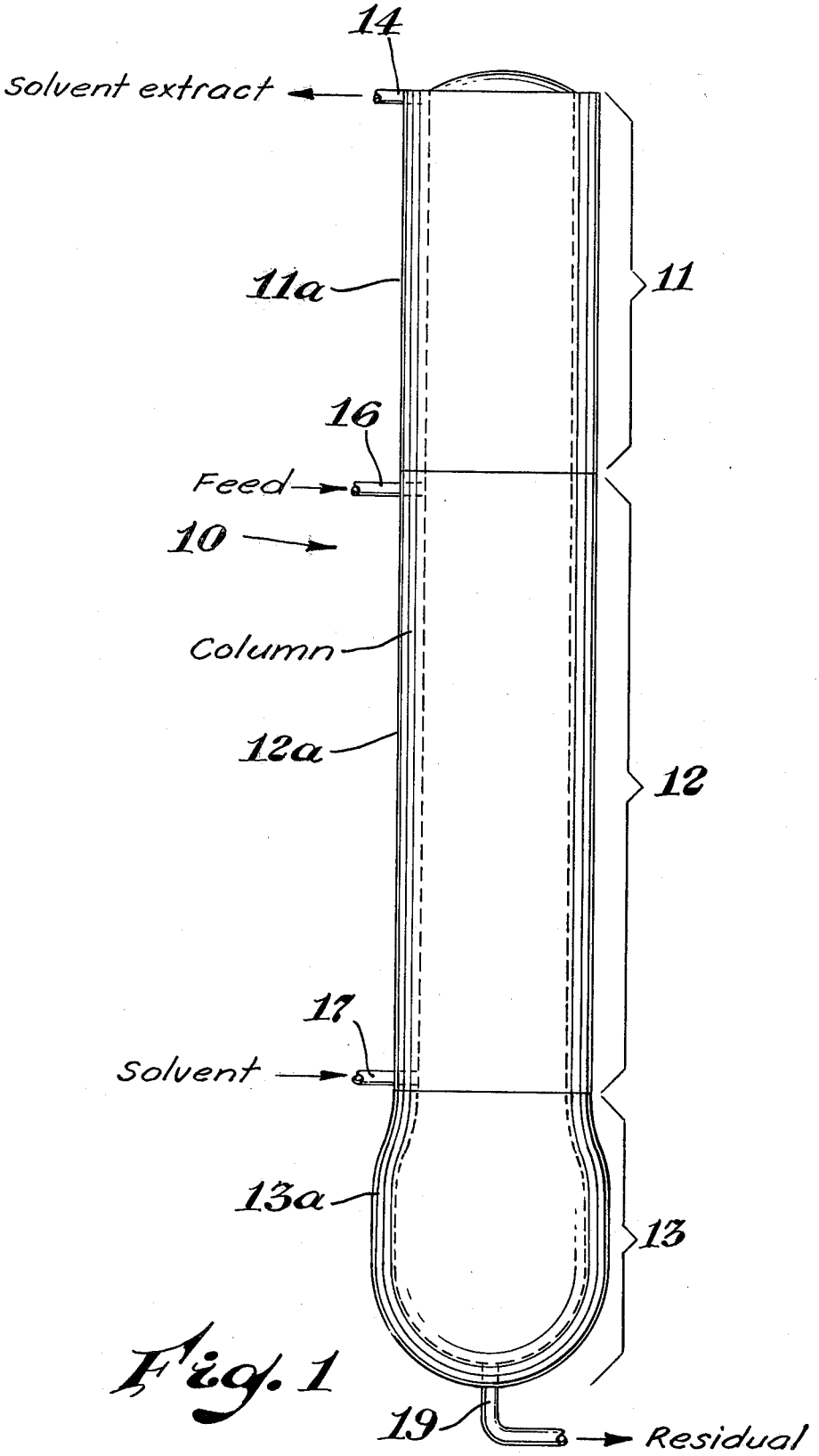
FIG. 1 is a preferred, specific embodiment of a vertical column.

In FIG. 1, a vertical column 10 consists of a first or settling zone 11, a second or contacting zone 12, and a third or collection zone 13. Zone 11 is equipped with a solvent-premium oil outlet 14 and a thermal jacket 11*a*. Zone 12 is equipped with a slurry inlet 16, a solvent inlet 17 and a thermal jacket 12*a*. Zone 13 is equipped with a residual slurry outlet 19 and a thermal jacket 13*a*.

Figure 2:
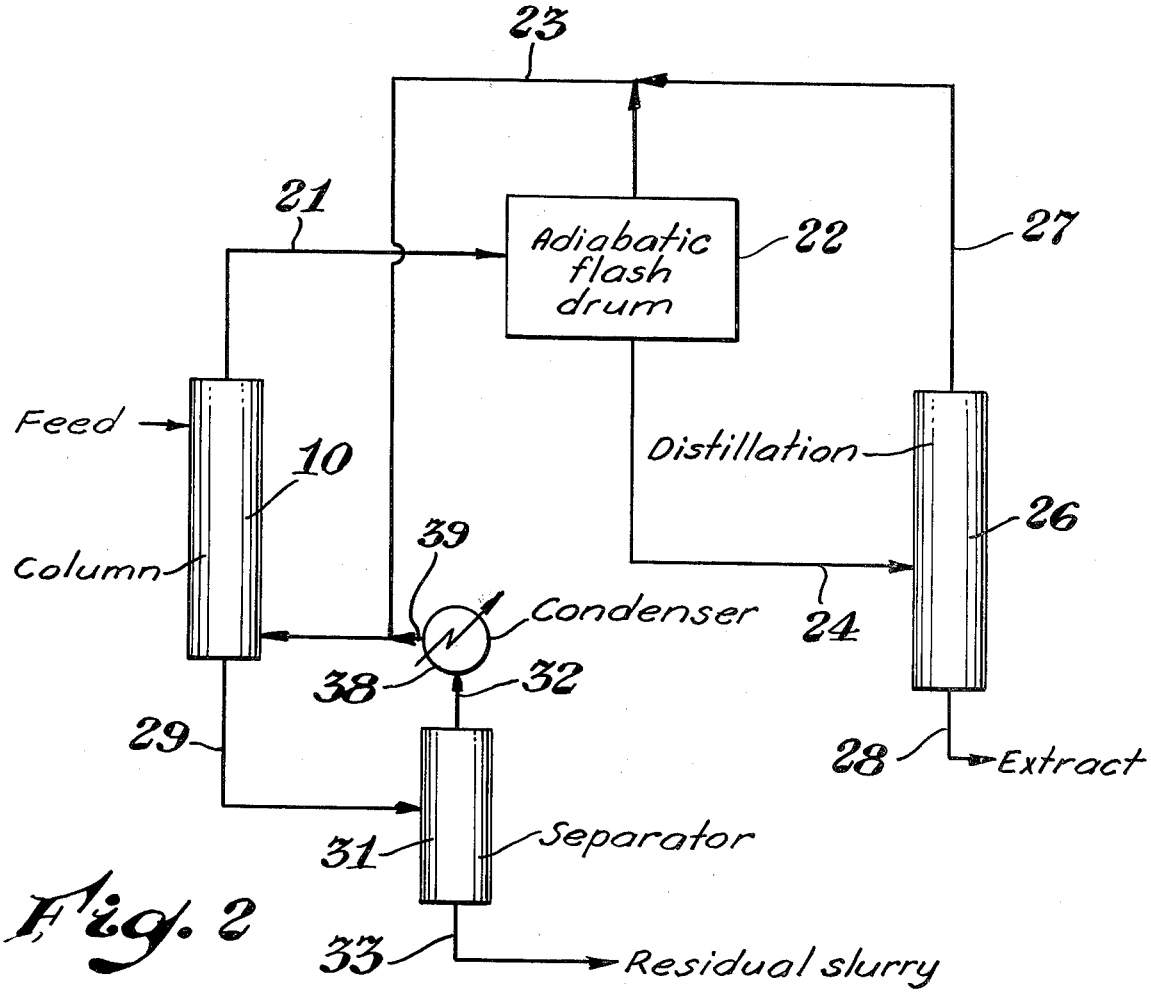
FIG. 2 is a schematic flow diagram illustrating the vertical column of FIG. 1 in a specific combination with conventional, downstream separation equipment.

In FIG. 2, column 10 is connected to an adiabatic flash drum 22 by conduits 21 and 23. A distillation unit 26 equipped with a removal conduit 28 is joined both to flash 22 by conduit 24 and to column 10 by conduits 27 and 23. Conduits 27 and 23 are mated with each other. A separator 31 is connected to column 10 by conduit 29. A conduit 33 proceeds from separator 31 and a conduit 32 joins separator 31 with a condenser 38 which in turn is joined to column 10 by mated conduits 39 and 23.

Figure 3:
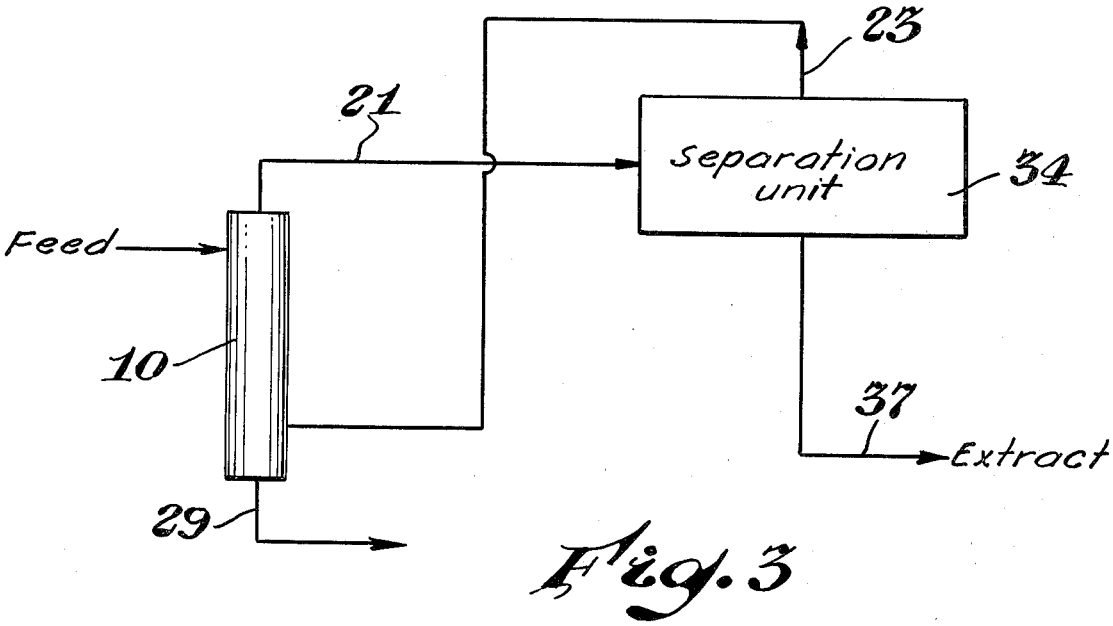
FIG. 3 is a schematic flow diagram illustrating a variation of the combination shown in FIG. 2.

In FIG. 3, a separation unit 34 replaces the adiabatic flash drum 22 and distillation unit 26 of FIG. 2. Unit 34 is connected to column 10 by conduits 21 and 23 and is equipped with a removal conduit 37.

Having thus described the apparatus and referring now to FIG. 1, a slurry is continuously charged to column 10 through slurry inlet 16 while a nonpolar solvent is simultaneously and continuously charged to column 10 through solvent inlet 17. The solvent passes up and through zone 12 while the slurry simultaneously passes down and through the same. During this continuous, simultaneous passing, the solvent and slurry are in intimate contact and the solvent extracts from the slurry the premium oil which is soluble in the solvent at the zone 12 conditions, thus producing a first fraction comprising the solvent and premium oil and a second fraction (residual slurry) comprising the fine solids and polar liquids. The solvent and premium oil are continuously transported into zone 11 and removed therefrom through outlet 14. The residual slurry is continuously collected in zone 13 and removed therefrom through residual slurry outlet 19.

Referring now to FIG. 2, the solvent-premium oil mixture present in zone 11 of column 10 in the form of a substantially quiescent pool is removed as an overflow and is passed through conduit 21 to flash drum 22 where some of the solvent is separated from the premium oil and recycled to column 10 via conduit 23. The remaining solvent-premium oil mixture is transferred to distillation unit 26 where the remaining solvent is distilled overhead and recycled to column 10 via conduits 27 and 23 while the premium oil is removed as an underflow through removal outlet 28.

The residual slurry collected in zone 13 of column 10 is removed as an underflow and is passed to separator 31 via conduit 29. Separator 31 recovers any solvent present in the residua and recycles it to column 10 via conduit 32, condenser 38, and conduits 39 and 23. The remaining residual slurry is removed as an underflow via conduit 33.

Referring now to FIG. 3, the overflow from column 10 can be transferred (via conduit 21) to a single-stage solvent removal (recovery) unit, such as separation unit 34. Therein, the solvent is separated from the premium oil and recycled to column 10 via conduit 23 while the extract is removed via conduit 37. The choice between unit 34 and the combination of units 22 and 26 is governed by the needs of the practitioner.

The recovered, high-solids content residual slurry is suitable as a gasification feedstock. The hydrogen:carbon ratio in this material is generally the same as or lower than that of liquefaction feed coal. Thus, if this material is used as fuel, the expenditure of hydrogen is minimized. The premium oil is a desirable recycle oil, a low-sulfur fuel or a feedstock for petrochemicals. This material is generally recovered as a bottom stream from a solvent distillation unit.

The process of this invention is particularly well adapted for the separation of a slurry produced by high temperature hydrogenation of coal into a first fraction of premium oil and a second fraction of fine solids and polar liquids. The slurry differs from petroleum type materials in several salient aspects.

First, the slurries of this invention typically contains about 2 to 15 weight percent ash and about 1 to 8 percent unconverted organic solids.

Second, the softening temperature of the residual slurry tends to be considerably higher than for petroleum-derived asphaltenes. Consequently, while propane slurry separators (deasphalters) can operate at temperatures below 100° C. with a fluid residual product, the viscosity of the asphaltenic residue produced by this invention is typically between 100,000 and 200,000 cps at 200° C.

Third, the coal-derived liquids of this invention tend to contain a larger fraction of solvent-insoluble oil, i.e., polar liquids.

Fourth, due to the highly aromatic nature of the coal-derived oil and the large amounts of heteroatom-containing organics, particularly phenolics, the difference in interfacial tension between the premium oil and solvent tends to be greater for the coal-derived oil than for the petroleum-derived oils. This later difference is believed to significantly effect the operation of the invention here described. The Marangoni effect is directly related to this interfacial tension difference.

Not to be bound by theory, it is believed that the mechanism of extraction occurring in the process of this invention is a manifestation of the Marangoni effect, a description of which follows. When an oil containing a mixture of polar and nonpolar species is contacted with a nonpolar solvent, interfacial tension forces tend to cause the nonpolar species to concentrate at the oil surface. These nonpolar species are rapidly extracted by the nonpolar solvent, leaving a high concentration of polar species near the oil surface with a relatively high interfacial tension—a thermodynamically unstable situation.

This thermodynamic driving force sets up circulation patterns in the oil phase which transfer nonpolar species from the interior of the oil phase to the interface where they are extracted. These circulation patterns cause rapid movement at the interface and extremely high mass transfer rates. The interfacial tension forces which drive the circulation patterns are opposed by the viscous effects in the oil phase. Consequently, high viscosity near the oil surface will dampen the circulation patterns.

When the solvent-oil interface is generated by introducing oil into the solvent in the form of drops, e.g., from a small tube, the Marangoni instability leads to a marked enhancement of the concomitant processes of dispersal and dissolution, i.e., to a rapid destruction of the droplet into numerous smaller droplets with an accompanying extraction of the premium oil into the solvent. Other studies have shown that when a viscous oil or polar solvents, like benzene or toluene, are used, the rapid rate of destruction does not occur. This Marangoni instability is believed to occur under the operating conditions of the instant invention. As a consequence, the selection of solvent used in this invention preferably is such that the Marangoni effect is promoted. Solvents that do not promote this effect, such as benzene or toluene, literally extract all the liquid from the slurry thus producing powder for ultimate discharge as an underflow. As such, polar liquids are not separated from the premium oil but are carried into the settling zone and removed as part of the overflow.

The Marangoni instability greatly enhances liquid-liquid extraction by providing large interfacial areas which thereby reduces the residence time required in the extraction zone. This in turn permits the use of equipment having smaller volume dimensions for a given volume of slurry and solvent and simplifies the design of the slurry inlet system, i.e., eliminates the need for closely controlling the initial droplet size of the slurry previously necessary to obtain an extremely fine dispersion of slurry into the solvent. Thus, the hallmark of this invention is the use of one of a specific group of solvents in combination with a temperature differential between various portions of the column wall to facilitate the handling of the residue as a viscous liquid slurry. Such a combination not only renders the operation of this invention facile, but it also promotes a desirable separation of the premium oil from the polar liquids and fine solids.

The following examples are illustrative of certain, specific embodiments of this invention. Unless otherwise noted, all parts and percentages are by weight.

SPECIFIC EMBODIMENTS

Apparatus and Procedure

A jacketed, vertical column (3 in. inner diameter, 54 in. length) having a design similar to that described by FIG. 1 was employed. The first and second zones were operated at a temperature of about 160° C. and a pressure of about 200 psig and the third zone was operated at a temperature of about 200° C. at a pressure of about 200 psig. The pressure in the column was controlled by a back pressure controller and a valve on the heated (150° C.) solvent-premium oil outlet. This outlet fed into an adiabatic flash drum. There the solvent was flashed, removed and subsequently condensed and recycled to a solvent feed tank. Premium oil from the flash drum was stripped of any residual solvent with a continuously fed distillation unit.

Residual slurry was removed from the column by a control valve. A level controller capable of detecting the interface between the residual slurry and solvent-premium oil phases was used to control the asphaltene outlet valve.

Hexane was used as the solvent and the column was fed various slurries at the rate of about 45 lb/hour. A hexane:slurry weight ratio of about 0.8:1 was used.

Analytical Procedures

In the following examples, the analytical procedures employed were as follows:

Viscosity

Viscosities of product liquids were measured at 25° C. using a Brookfield Viscometer. Ash was not removed from these liquids prior to the measurement.

Toluene Insolubles

Product liquid (40 g) was shaken with toluene (160 g) and subsequently centrifuged. The supernatant liquid was decanted and the remaining residue, toluene-insoluble hydrocarbons and ash, was vacuum-dried at 100° C. and weighed. The ash content of the residue was determined by ANSI/ASTM D482-74.

Asphaltenes

Product liquid (25 g) was shaken with n-hexane (100 g) and subsequently centrifuged. The supernatant liquid was decanted and the residue (a mixture of ash, toluene insolubles, and toluene-soluble hydrocarbons which are insoluble in n-hexane, i.e., asphaltenes) was vacuum-dried at 100° C. and weighed. The asphaltene content was determined by subtracting toluene-insolubles and ash previously determined from the total hexane-insolubles.

Coal Analysis

The coal used to generate the various liquefaction product liquids purified below was Pittsburg No. 8 Allison mine bituminous coal crushed, dried, pulverized and classified such that 99.9 percent would pass through a 120 mesh screen. The sulfur content was about 3.9 percent.

EXAMPLES 1-3

In Tables I-III are listed data from three operations employing different feed slurries, i.e., Table I-Hydrocyclone Underflow (12.6 percent ash), Table II-Liquefaction Product (5.2 percent ash) and Table III-Centrifuge Overhead (2.1 percent ash). Heat of combustion ($\Delta H_c$) was determined by ANSI/ASTM D2015-66 and Ramsbottom Carbon was determined by ANSI/ASTM D524-76.

TABLE I

IMPURITIES REMOVAL FROM A HYDROCYCLONE UNDERFLOW SLURRY

| | Feed | Purified Product Liquid | Asphaltenes |
|---|---|---|---|
| Amount, lb | 517.5 | 368.1 | 134.1 |
| Amount, wt % | 100.0 | 73.3 | 26.7 |
| Analyses: | | | |
| Viscosity, cps, 25° C. | 320 | 60 | — |
| Toluene Insolubles, % | 9.8 | 0.84 | — |
| Asphaltenes, % | 21.2 | 18.6 | — |
| Ash, % | 12.4 | 0.33 | 41.2 |
| Carbon, wt % | — | — | 48.9 |
| Hydrogen, wt % | — | — | 3.19 |
| Sulfur, wt % | — | — | 4.1 |
| Nitrogen Analysis, wt % | — | — | 0.72 |
| $\Delta H_c$, BTU/lb | — | — | 9,080 |
| Ramsbottom Carbon, wt % | — | 11.1 | 72.7 |

TABLE II

IMPURITIES REMOVAL FROM A LIQUEFACTION SLURRY

| | Feed | Purified Product Liquid | Asphaltenes |
|---|---|---|---|
| Amount, lb | 4066.0 | 3219.0 | 718.3 |
| Amount, wt % feed | 100.0 | 79.17 | 17.67 |
| Amount, wt % products | — | 81.76 | 18.24 |
| Accountability = 96.8% | | | |
| Analyses: | | | |
| Viscosity, cps, 25° C. | 632 | 152 | — |
| Toluene Insolubles, % | 11.81 | 3.12 | — |
| Asphaltenes, % | 33.47 | 29.93 | — |
| Ash, % | 5.02 | 0.12 | 28.14 |
| Carbon, wt % | — | — | 61.63 |
| Hydrogen, wt % | — | — | 3.99 |
| Sulfur, wt % | — | — | 2.94 |
| $\Delta H_c$, BTU/lb | — | — | 10,880 |

TABLE III

IMPURITIES REMOVAL FROM A CENTRIFUGE OVERFLOW SLURRY[1]

| | Feed | Purified Product Liquid | Asphaltenes |
|---|---|---|---|
| Amount, wt % | 100.0 | 88.3 | 11.7 |
| Analyses: | | | |
| Viscosity, cps, 25° C. | 670 | 83 | — |
| Toluene Insolubles, % | 9.1 | 2.4 | — |
| Asphaltenes, % | 36 | 29 | — |
| Ash, % | 1.9 | 0.09 | 17.7 |
| Carbon, wt % | — | — | 72.0 |
| Hydrogen, wt % | — | — | 4.2 |
| Sulfur, wt % | — | — | 1.7 |
| "$H_c$, BTU/lb | — | — | 13,200 |
| Ramsbottom Carbon, wt % | — | — | 74 |

[1]Represents average data based upon several runs made with this type of feed slurry. As a result, information on the total material fed and recovered and material balance accountability is not available.

These data demonstrate, over a wide array of solid-containing slurries, the low residuum of ash in the purified product liquid (overflow) and the low residuum of hexane-soluble hydrocarbon in the residual slurry.

EXAMPLE 4

A series of experiments were conducted to determine the degree of solubility of coal-derived oil in pentane, hexane (a mixture of $C_6$ paraffins as contained in commercial grade hexane solvents), cyclohexane, n-decane and toluene, respectively. For each solvent the oil solubility was measured for a series of solvent to oil ratios. The oil solubility was determined by weighing the appropriate amount of solvent and oil into an 8 ounce bottle, shaking the bottle mechanically for at least 20 minutes to thoroughly mix the two materials, centrifuging the bottles containing the mixture for at least 20 minutes to cause the insoluble phase to collect in the bottom of the bottle, decanting the liquids from the insoluble residue, vacuum-drying the residue at about 80° C., determining the residue weight and finally calculating the percent of the sample which was insoluble (% soluble oil = 100% − % insoluble). The results are reported in Table IV.

TABLE IV

% OF SAMPLE WHICH IS INSOLUBLE

| Solvent Wt. / Oil Wt. | Solvent: Pentane | Hexane | Hexane | Cyclo Hexane | Toluene |
|---|---|---|---|---|---|
| 0.1 | 36.08 | 34.76 | — | — | — |

TABLE IV-continued

| % OF SAMPLE WHICH IS INSOLUBLE | | | | | |
|---|---|---|---|---|---|
| | Solvent | | | | |
| Solvent Wt. / Oil Wt. | Pentane | Hexane | Hexane | Cyclo Hexane | Toluene |
| 0.2 | 28.03 | 26.37 | — | — | |
| 0.4 | 41.08 | 36.54 | 19.8 | 25.8 | 9.8 |
| 0.8 | 44.44 | 39.99 | 18.1 | 27.5 | 9.8 |
| 1.0 | — | — | 18.9 | 27.6 | 9.4 |
| 1.6 | 46.26 | 39.26 | — | — | — |
| 3.2 | 43.21 | 36.71 | — | — | — |
| 6.4 | 43.36 | 30.20 | — | — | — |
| Oil Sample | A | A | B | B | B |

Oil samples A and B are both samples of coal liquefaction products with initial boiling points of about 150° C. which had been centrifuged prior to this experimentation to remove all but a small fraction of the solids present (less than about 2–3 percent of sample is filterable solids).

EXAMPLE 5

A series of experiments were performed as in Example IV using hexane and decane as solvents. The oil used was the ash-rich fraction obtained by hydrocloning the 150° C.+ product slurry from the liquefaction of Pittsburgh No. 8 coal. The results are reported in Table V.

TABLE V

| % OF SAMPLE WHICH IS IN SOLUBLE* | | |
|---|---|---|
| | Solvent | |
| Solvent Wt. / Oil Wt. | Hexane | Decane |
| .1 | 19.79 | 21.14 |
| .3 | 15.17 | 16.86 |
| .7 | 24.87 | 24.75 |
| 1.0 | 28.71 | 26.91 |
| 2.0 | 28.96 | 30.94 |
| 4.0 | 29.63 | 26.23 |

*Insolubles in the initial sample on an ash-free basis.

To assess the effectiveness of the solvent precipitation, the ash levels in the decanted liquids were determined for selected samples as shown below:

TABLE VI

| % ASH IN DECANTED SOLVENT AND OIL | | |
|---|---|---|
| | Solvent | |
| Solvent Wt. / Oil Wt. | Hexane | Decane |
| 0.1 | 0.02 | 0.01 |
| 0.3 | 0.0 | 0.0 |

From the data presented in Tables IV–VI, a number of observations and conclusions are pertinent. First, while the amount of insoluble materials shows variations depending on the oil used and the solvent:oil ratio, and to a lesser degree on experimental uncertainty, there is a greater amount of insoluble material recovered for a given solvent:oil ratio and a given oil sample when pentane, hexane, cyclohexane or decane (all nonpolar solvents) is used than when the solvent is toluene (a polar solvent).

Second, when the solvent is toluene, significantly less insoluble material is obtained due to the higher solubility of coal-derived oil in toluene than in paraffinic hydrocarbons.

Third, even at very low solvent:oil ratios the ash is very effectively removed from the soluble oil by the practice of this invention. Centrifugation of whole oil samples results in ash levels of 1–2 percent in the decanted oil.

Fourth, because of the increased solubility of the oil in hydrocarbon solvents at elevated temperatures, the operation of the deasphalter with an aromatic solvent such as toluene can be expected to result in little nonsolid residue being separated as insoluble material. Residue obtained under these circumstances is not a viscous slurry but a powder wet with solvent. Problems with the removal of such a residue prevented extended operation with toluene as a solvent. Xylene, ethylbenzene and other mono aromatics would be expected to perform in a manner similar to toluene.

EXAMPLE 6

A room temperature study was conducted to observe the effect of solvent on the occurrence of Marangoni instability. Hexane was placed in a glass vessel filled to a depth of about 6 inches. A coal-derived oil which contained about 0.1 percent ash, 1 percent toluene insolubles and 22 percent asphaltenes was used as the test sample. When this oil was added to the hexane dropwise from about 1 inch above the hexane liquid surface rapid drop dispersion was observed. A photographic study of the phenomena indicated droplet dispersion began before the oil had penetrated the hexane more than 1 inch. Secondary droplets whose diameters were less than 1/20th that of the initial oil droplet were formed within one second and before the oil had penetrated the hexane more than 2 inches. Simultaneously a clouding of the solvent in the vicinity indicated that extraction of a portion of the oil had occurred.

When the identical experiment was performed using toluene in place of hexane as the solvent, no drop dispersion occurred. The oil drop settled through the solvent and rested on the bottom of the vessel with minimal extraction having occurred. The toluene solvent was only slightly discolored by the passage of the oil drop through it.

This data supports the importance of the Marangoni effect in the rapid and effective extraction of the deasphalter feed slurry. The choice of solvents which are less polar than monoaromatics, for example, $C_5$–$C_9$ paraffins, is thus essential to obtain proper operation of the process.

EXAMPLE 7

Using the apparatus and procedure of Examples 1–3, an extraction experiment was conducted in which coal-derived product oil with the below-described composition was processed. Oil feed rate was about 48.6 pounds per hour and hexane feed rate was about 36.5 pounds per hour. For this experiment the column extraction zone temperature was about 190° C. The residue collection zone was hotter, i.e., the wall temperatures were 204° C. and 207° C. at the middle and bottom of the collection zone, respectively. The temperature in the center of the third zone was 195° C. Operations under these conditions resulted in the by-passing of significant amounts of hexane and hexane soluble oil through the residue outlet line. About 15 weight percent of the material in the residue collection vessel was a low viscosity hexane-oil mixture rather than the desired viscous slurry. A sample of the oil was analyzed after decanting as indicated below. A hexane material balance indicated that much more than the usual amount of hexane had escaped through the third zone outlet.

TABLE VII

| | ANALYSES | | | |
|---|---|---|---|---|
| | Feed Oil | Product Oil | Decanted Oil* | Total Residue |
| Viscosity at 25° C. | 375 | 95 | 3000 | |
| Ash % | 8.14 | .002 | 14.22 | 30.54 |
| % Toluene Insolubles | 9.78 | .83 | 17.26 | |
| % Asphaltenes | 21.12 | 17.17 | 25.80 | |

*Decanted from material in residue collection zone.

EXAMPLE 8

As a continuation of the operation described in Example 7, the extraction process was kept in operation while the temperature of the wall of the third zone was increased. After reaching steady state the following temperature profile was recorded: Zone 2,190° C.; wall temperature at the middle and bottom of Zone 3,225° C. and 255° C.; temperature in the center of Zone 3,212° C. At these operating conditions no decantible oil was observed in the residue collection zone. Product quality was as follows:

TABLE VIII

| | ANALYSES | | |
|---|---|---|---|
| | Feed Oil | Product Oil | Residue |
| Viscosity at 25° C. | 375 | 62 | |
| % Ash | 8.14 | .004 | 35.15 |
| % Toluene Insolubles | 9.78 | .88 | — |
| % Asphaltenes | 21.12 | 17.08 | — |

A comparison of the data presented in Tables VII and VIII support the need for maintaining the wall temperature of the third zone at a temperature of about 20° C. higher than the wall temperature of the rest of the column if a viscous residual slurry is to be recovered from Zone 3.

Although the invention has been described in considerable detail through the preceding specific embodiments, it is to be understood that these embodiments are only for purposes of illustration. Many variations and modifications can be made by one skilled in the art without departing from the spirit and scope of the invention.

We claim:

1. An improved process for separating a feed slurry produced by high temperature hydrogenation of a solid hydrocarbonaceous fuel and comprising fine solids, polar liquids and premium liquid oil, into a first fraction comprising the premium liquid oil and a second fraction comprising the fine solids and polar liquids, the process comprising:

(a) contacting the feed slurry with a nonpolar liquid solvent selected from the group consisting of (1) $C_5$–$C_9$ aliphatic hydrocarbon, (2) $C_5$–$C_9$ alicyclic hydrocarbon and (3) naphthenic or paraffinic fraction of a coal liquefaction product containing less than about 10 weight percent aromatic compounds, said contacting conducted in a vertical column defining an upper settling zone, a contacting zone and a lower collection zone, that portion of the column defining the collection zone having a column wall which is at a temperature at least about 20° C. above the temperature of the column wall defining said contacting zone the settling and contacting zones being operated at a temperature between about 100° C. and about 250° C. and at a pressure sufficient to maintain both the feed slurry and solvent in a liquid state but less than about 450 psi, the feed slurry being introduced into the column at or near the top of the contacting zone and the solvent introduced into the column at or near the bottom of the contacting zone, the solvent and feed slurry being contacted at a solvent:slurry weight ratio of at least about 0.5:1 and contacted in such a manner that the solvent:
   (1) passes up and through the column while the feed slurry passes down and through the column;
   (2) is in intimate contact with the feed slurry as they simultaneously pass through the column; and
   (3) extracts from the feed slurry as they simultaneously pass through the column the premium liquid oil;
(b) recovering from the settling zone of the column as an overflow said first fraction; and
(c) recovering from the collection zone of the column as a viscous slurry underflow said second fraction.

2. The process of claim 1 wherein said feed slurry is produced from coal.

3. The process of claim 2 wherein said solvent:slurry weight ratio of step (a) is between about 0.6:1 and about 5:1.

4. The process of claim 3 wherein the solids content of said feed slurry is less than about 25 weight percent of the slurry.

5. The process of claim 4 wherein the underflow comprises less than about 65 weight percent solids.

6. The process of claim 5 wherein the liquid solvent is at least one $C_5$–$C_9$ aliphatic or alicyclic hydrocarbon.

7. The process of claim 6 wherein the temperature of that portion of the column wall defining the collection zone is at least about 150° C.

* * * * *

UNITED STATES PATENT AND TRADEMARK OFFICE

CERTIFICATE OF CORRECTION

PATENT NO. : 4,180,456

DATED : December 25, 1979

INVENTOR(S) : Norman G. Moll and George J. Quarderer

It is certified that error appears in the above-identified patent and that said Letters Patent are hereby corrected as shown below:

Col. 2, line 68, "naphtenic" should read -- naphthenic --.

Col. 10, line 34, "$H_c$, BTU/lb" in Table III should read --$\Delta H_c$, BTU/lb --.

Col. 11, line 31, the heading in Table V "% OF SAMPLE WHICH IS IN SOLUBLE*" should read -- % OF SAMPLE WHICH IS INSOLUBLE* --.

Col. 13, line 10, footnote under Table VII "*Decanted from material in residue collection zone." should read --*Decanted from material in residue collection vessel.--

Signed and Sealed this

*Thirteenth* Day of *May 1980*

[SEAL]

*Attest:*

SIDNEY A. DIAMOND

*Attesting Officer*

*Commissioner of Patents and Trademarks*